US009202642B2

(12) United States Patent
Jang

(10) Patent No.: US 9,202,642 B2
(45) Date of Patent: Dec. 1, 2015

(54) MAGNETIC CONTACTOR

(71) Applicant: LSIS CO., LTD., Anyang-si, Gyeonggi-do (KR)

(72) Inventor: Hyun Il Jang, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/473,629

(22) Filed: Aug. 29, 2014

(65) Prior Publication Data

US 2015/0130569 A1 May 14, 2015

(30) Foreign Application Priority Data

Nov. 8, 2013 (KR) ..... 10-2013-0135789

(51) Int. Cl.

| | |
|---|---|
| ***H01H 13/04*** | (2006.01) |
| ***H01H 3/28*** | (2006.01) |
| ***H01H 47/00*** | (2006.01) |
| ***H01H 50/20*** | (2006.01) |
| ***H01H 51/00*** | (2006.01) |
| *H01H 47/22* | (2006.01) |
| *H01H 50/60* | (2006.01) |

(52) U.S. Cl.

CPC ..... *H01H 3/28* (2013.01); *H01H 47/00* (2013.01); *H01H 50/20* (2013.01); *H01H 51/005* (2013.01); *H01H 47/22* (2013.01); *H01H 50/60* (2013.01)

(58) Field of Classification Search

CPC ..... H01H 3/28; H01H 63/02; H01H 67/02; H01H 50/16; H01H 1/64

USPC ..... 335/202

See application file for complete search history.

(56) References Cited

U.S. PATENT DOCUMENTS

| | | | | | |
|---|---|---|---|---|---|
| 3,060,355 | A | * | 10/1962 | Kruzic | 335/277 |
| 4,931,757 | A | * | 6/1990 | Lemmer et al. | 335/131 |
| 4,969,844 | A | * | 11/1990 | Sako et al. | 439/733.1 |
| 5,281,937 | A | * | 1/1994 | Young | 335/132 |
| 5,517,167 | A | * | 5/1996 | Yamamoto et al. | 335/132 |

(Continued)

FOREIGN PATENT DOCUMENTS

| | | |
|---|---|---|
| DE | 19530496 | 6/1996 |
| EP | 1353348 | 10/2003 |

(Continued)

OTHER PUBLICATIONS

Korean Intellectual Property Office Application Serial No. 10-2013-0135789, Notice of Allowance dated Mar. 26, 2015, 2 pages.

(Continued)

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

Disclosed is a magnetic contactor. A free space in which a DC converting circuit is provided is in a product can be secured by changing shapes of the movable core and the fixed core, and thus, in association with a low-capacity product, external AC power may be converted into DC power even without enlarging a size of a product. Also, a normal position member may be included in a movable core, and may induce the movable core to the original position, and thus, a mechanical mechanism relationship between the switch manipulating part included in the movable core and the other element is maintained.

14 Claims, 10 Drawing Sheets

(56) References Cited

U.S. PATENT DOCUMENTS

| | | | | |
|---|---|---|---|---|
| 5,600,291 | A * | 2/1997 | Duchemin et al. | 335/132 |
| 5,623,239 | A * | 4/1997 | Sitar | 335/132 |
| 5,680,083 | A * | 10/1997 | Kogawa et al. | 335/132 |
| 5,684,442 | A * | 11/1997 | Hufschmid | 335/132 |
| 6,034,585 | A | 3/2000 | Donhauser | |
| 6,111,488 | A * | 8/2000 | Nakamura et al. | 335/132 |
| 6,411,184 | B1 * | 6/2002 | Comtois et al. | 335/106 |
| 6,424,243 | B1 | 7/2002 | Forster | |
| 6,472,963 | B1 * | 10/2002 | Liu et al. | 335/132 |
| 8,653,916 | B2 * | 2/2014 | Naka et al. | 335/192 |
| 2006/0125581 | A1 * | 6/2006 | Ohkubo et al. | 335/132 |
| 2006/0152311 | A1 * | 7/2006 | Ohkubo et al. | 335/132 |
| 2009/0315653 | A1 * | 12/2009 | Suzuki et al. | 335/185 |
| 2010/0308944 | A1 * | 12/2010 | Kurashige et al. | 335/202 |
| 2012/0326815 | A1 | 12/2012 | Suzuki et al. | |
| 2015/0002247 | A1 * | 1/2015 | Rho | 335/133 |
| 2015/0061797 | A1 * | 3/2015 | Yeon et al. | 335/194 |

FOREIGN PATENT DOCUMENTS

| | | |
|---|---|---|
| JP | 38-25131 | 11/1963 |
| JP | 59-203334 | 11/1984 |
| JP | 03-101028 | 4/1991 |
| JP | 08-077906 | 3/1996 |
| JP | 2011-044278 | 3/2011 |
| KR | 20-0430937 | 11/2006 |

OTHER PUBLICATIONS

European Patent Office Application Serial No. 14183213.9, Search Report dated Mar. 26, 2015, 5 pages.

Japan Patent Office Application Serial No. 2014-192351, Office Action dated Jul. 14, 2015, 3 pages.

* cited by examiner

MAGNETIC CONTACTOR

CROSS-REFERENCE TO RELATED APPLICATION

Pursuant to 35 U.S.C. §119(a), this application claims the benefit of earlier filing date and right of priority to Korean Application No. 10-2013-0135789, filed on Nov. 8, 2013, the contents of which are all hereby incorporated by reference herein in its entirety.

BACKGROUND OF THE DISCLOSURE

1. Field of the Disclosure

The present disclosure relates to a magnetic contactor in which a free space, where a DC converting circuit is provided, can be secured in association with a low-capacity product.

2. Background of the Disclosure

Generally, magnetic contactors are devices that switch power (a current) flowing in a main circuit by using the electromagnet principle. The magnetic contactors may be divided into, for example, medium•low-capacity products of less than 130 A and high-capacity products of 130 A to 800 A depending on a current capacity.

FIG. 1 is an exploded perspective view schematically illustrating a configuration of a prior art medium•low-capacity magnetic contactor. The magnetic contactor includes an upper frame 11, a movable core 12, a backspring 13, a bobbin 14, a fixed core 15, and a lower frame 16.

The bobbin 14 is a cylinder-shaped hollow iron core, and a coil 14*a* is wound around an outer surface of the cylinder-shaped iron core. When a current flows in the coil 14*a*, a magnetic field is generated around the coil 14*a*, and the fixed core 15 having an E-shape is magnetized by the magnetic field to become an electromagnet.

The movable core 12, which has an E-shape and is disposed on the backspring 13, is downward absorbed by a magnetic force of the magnetized fixed core 15, and a movable contact mechanically connected to the movable core 12 is lowered to contact a fixed contact. Therefore, a power terminal is connected to a load terminal by a contact part, and thus, a current flows in a main circuit.

At this time, when a voltage applied to the coil 14*a* dissipates, the magnetic force generated around the coil 14*a* is also released, and thus, the movable core 12 disposed on the backspring 13 is raised to the original position by an elastic restoring force of the backspring 13. Therefore, the movable contact is separated from the fixed contact, and thus, the current flowing in the main circuit is cut off.

However, in the prior art magnetic contactor, the movable core 12 and the fixed core 15 which have an E-shape occupy a large space in a product, and for this reason, when desiring to apply a method (which converts external alternating current (AC) power into direct current (DC) power and excites the DC power) to a low-capacity product, a free space in which a DC converting circuit is provided is insufficient.

SUMMARY OF THE DISCLOSURE

Therefore, an aspect of the detailed description is to provide a magnetic contactor in which a free space, where a DC converting circuit is provided in a product, can be secured.

To achieve these and other advantages and in accordance with the purpose of this specification, as embodied and broadly described herein, a magnetic contactor include a frame, a holder, a movable core, a bobbin, a fixed core, an elastic member, an inverting switch, an electronic circuit part, and a normal position member.

The frame may be configured to include a fixed contact which is connected to a power source and a load.

The holder may be movably provided in the frame, and configured to include a movable contact and a fixed contact which are disposed to contact each other and to be separated from each other.

The movable core may be coupled to one end of the holder, and configured to include a switch manipulating part.

The bobbin may be configured to include a coil which is wound around an outer surface, wherein the bobbin generates a magnetic force when external power is applied to the coil.

The fixed core may be coupled to the bobbin.

The elastic member may be disposed between the holder and the bobbin, wherein the elastic member restores the movable core to an original position when the external power is cut off.

The inverting switch may be provided within a moving range of the switch manipulating part, wherein an internal contact of the inverting switch is inverted when the inverting switch is contacted by switching manipulating part.

The electronic circuit part may be configured to include a voltage dropping element, and may receive an inversion signal from the inverting switch to control a current applied to the coil.

The normal position member may be configured to fix the switch manipulating part to a normal switch to induce a contact between the inverting switch and the switch manipulating part.

According an embodiment of the present invention, a free space in which a DC converting circuit is provided can be secured in a lower frame by changing shapes of the movable core and the fixed core.

According an embodiment of the present invention, the movable core may have a structure in which the movable core is inserted into the bobbin, and may be movable within a certain distance.

The fixed core may have a box-shaped structure in which the fixed core is opened in both directions, and the fixed core is hollow.

The fixed core may be symmetrically separated with respect to a length-direction central line of the bobbin, and may be detachably coupled to a side of the bobbin.

The electronic circuit part may be provided at one side of the bobbin.

According an embodiment of the present invention, the normal position member may be included in the movable core, and may induce the movable core to the original position, and thus, a mechanical mechanism relationship between the movable core and the other element is maintained.

According to a first embodiment of the present invention, the movable core may include a connecting member and a support.

The connecting member may be coupled to a connecting shaft which is provided to protrude at one end of a movable core body.

The connecting member may be configured to include the switch manipulating part which is operably provided as one body.

The support may be stacked on and coupled to the connecting member by using the connecting shaft.

The support may be configured to connect the holder to the connecting member.

The normal position member may include a protrusion.

The protrusion may be formed to protrude on a boundary line between the support and the connecting member, and configured to prevent mutual torsion of the support and the connecting member.

According to a first embodiment of the present invention, the protrusion may be continuously formed to protrude along a border of the support.

According to a second embodiment of the present invention, a plurality of the protrusions are respectively formed in at least two borders, which are in different directions, among a plurality of borders of the support.

According to a third embodiment of the present invention, the protrusion may have a strip structure in which a plurality of the protrusions are formed to protrude in parallel at a border of the support.

According to a first embodiment of the present invention, the support may include a supporting plate and a coupling projection.

The supporting plate may be stacked on the connecting member.

The coupling projection may be formed at both ends of the support to extend toward the holder, wherein an end of the coupling projection is formed to protrude in an axial direction.

The connecting member may be coupled to the support by riveting by a connecting shaft.

According to a second embodiment of the present invention, the support may include a supporting plate, a side plate, and a supporting pin.

The supporting plate may be stacked on the connecting member.

The side plate may be formed at both ends of the supporting plate to protrude toward the holder.

The side plate may be configured to include an inserting hole.

The supporting pin may be coupled to the side member through the inserting hole.

The supporting pin may be coupled to the holder at both ends of the supporting pin.

According to a second embodiment of the present invention, the movable core may include a connecting member and a support.

The connecting member may be coupled to a connecting shaft which is provided to protrude at one end of a movable core body.

The connecting member may be configured to include the switch manipulating part which is operably provided as one body.

The support may be stacked on and coupled to the connecting member by using the connecting shaft.

The support may be configured to connect the holder to the connecting member.

The normal position member may include a coupling member configured to couple the support to the connecting member to prevent mutual torsion of the support and the switch manipulating part.

According to a third embodiment of the present invention, the movable core may include a connecting member and a support.

The connecting member may be coupled to a connecting shaft which is provided to protrude at one end of a movable core body.

The connecting member may be configured to include the switch manipulating part which is operably provided as one body.

The support may be stacked on and coupled to the connecting member by using the connecting shaft.

The support may be configured to connect the holder to the connecting member.

The normal position member may include an anti-torsion projection.

The anti-torsion projection may be separated from the connecting shaft at the connecting member, formed to protrude, and coupled to the support to pass through the support.

As described above, in the magnetic contactor according to the embodiments of the present invention, a free space in which a DC converting circuit is provided in a product can be secured by changing a shape and structure of an electromagnet core, namely, shapes and structures of the movable core and the fixed core. Accordingly, external AC power is converted into DC power even without enlarging a size of a product in association with a low-capacity product.

Moreover, the normal position member is included in the movable core and induces the movable core to a normal position, and thus, the switch manipulation part included in the movable core can maintain a mechanical mechanism relationship with another element.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

The present disclosure relates to a magnetic contactor in which a structure and shape of an internal element of a product are simplified, and thus, a free space in which a DC converting circuit is provided can be secured even without enlarging a size of the product.

Figure 1:
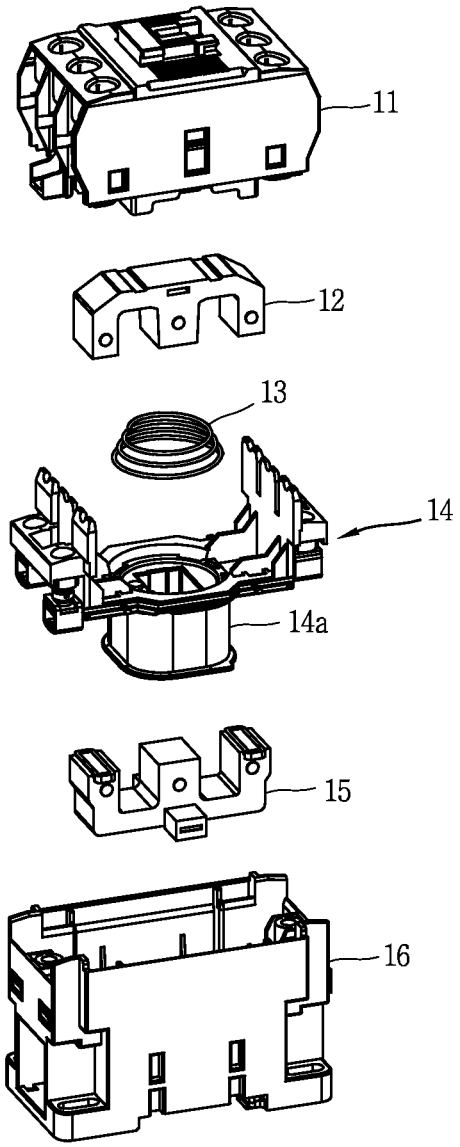
FIG. 1 PRIOR ART
FIG. 1 is an exploded perspective view schematically illustrating a configuration of a prior art medium•low-capacity magnetic contactor.
Figure 2:
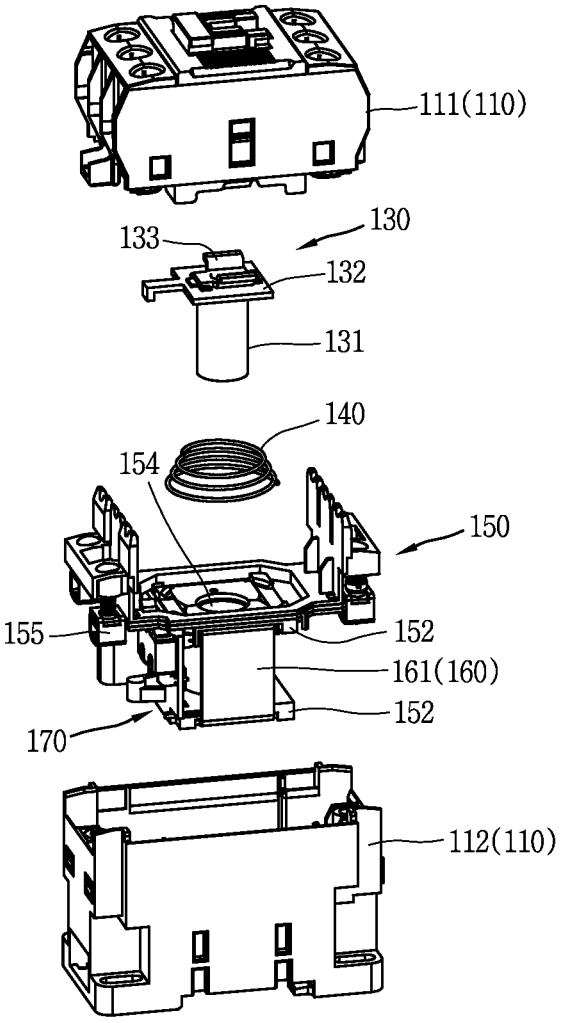
FIG. 2 is an exploded perspective view of a magnetic contactor according to an embodiment of the present invention.
Figure 3:
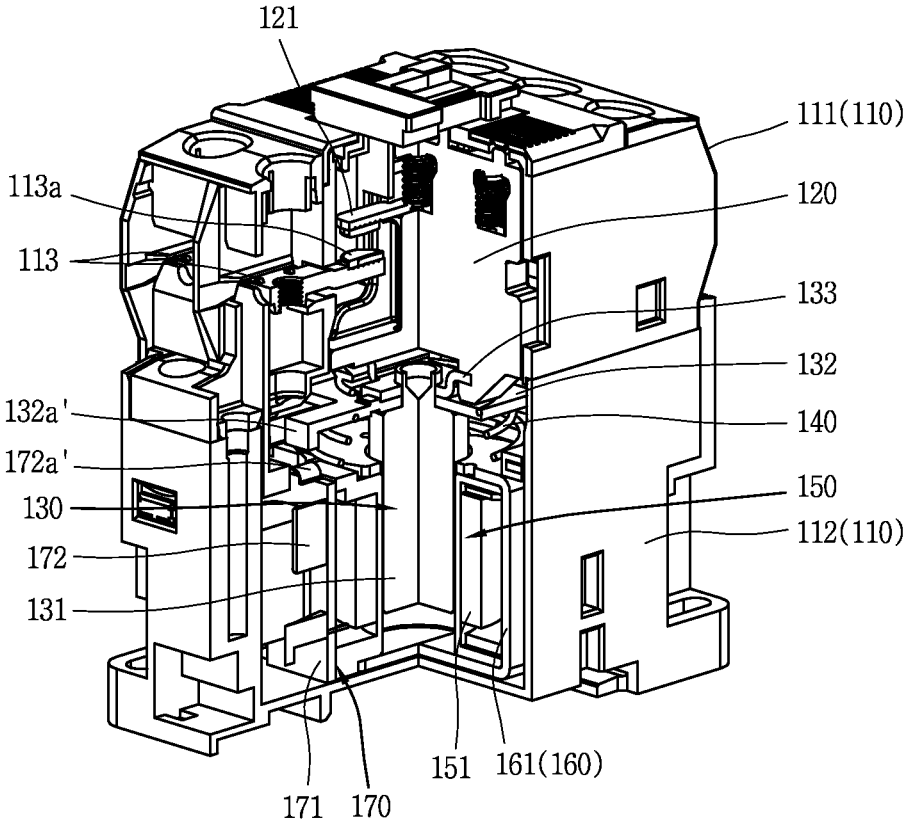
FIG. 3 is an assembly view of the magnetic contactor according to an embodiment of the present invention, and illustrates a state in which a portion (¼) of a product is cut.

FIG. 2 is an exploded perspective view of a magnetic contactor according to an embodiment of the present invention, and FIG. 3 is an assembly view of the magnetic contactor according to an embodiment of the present invention, and illustrates a state in which a portion (¼) of a product is cut.

The magnetic contactor according to an embodiment of the present invention includes a frame 110, a holder 120, a movable core 130, an elastic member 140, a bobbin 150, a fixed core 160, and an electronic circuit part 170.

Referring to the exploded view of FIG. 2, the frame 110 includes a first frame 111 and a second frame 112 which form an external appearance of a product. The first frame 111 faces the second frame 112, and is detachably assembled with the second frame 112.

For example, the first and second frames 111 and 112 may be opened toward each other. The first frame 111 may be adjacently disposed on the second frame 112, and may be stacked on and coupled to the second frame 112 by a coupling member 1344.

Referring to the assembly view of FIG. 3, the first frame 111 accommodates the holder 120, and the second frame 112 accommodates the movable core 130, the elastic member 140, the bobbin 150, and the fixed core 160.

The first frame 111 includes a plurality of main power terminals 113 which are connected to a power source and a load at left and right sides in a length direction.

Here, the power source is connected to one of the main power terminals 113 which is disposed length-direction one side of the first frame 111 coupled to the second frame 112, and the load is connected to the other main power terminal 113 which is disposed at the other side of the first frame 111 in the length direction.

In this case, when main power is three-phase AC power, the main power terminals 113 may be provided in parallel in R, S, and T phases, namely, three phases. A fixed contact 113*a* is provided as one body at one end of the main power terminal 113 connected to the power source and the load.

The holder 120 is provided in the first frame 111, and is provided in a direction from the first frame 111 to the second frame 112 to be movable in a vertical direction. As seen in the drawing, a moving direction of the holder 120 is a vertical direction (i.e., an upward and downward direction) with respect to a coupling surface between the first frame 111 and the second frame 112.

The holder 120 includes a movable contact 121, which is disposed to be separated from the fixed contact 113*a* in a vertical direction, for each phase. When the holder 120 is lowered in a direction from the first frame 111 to the second frame 112, namely, in a direction from an upper side to a lower side, the movable contact 121 also moves to and contacts the fixed contact 113*a*.

In the present embodiment, for convenience of description, in FIG. 2, the first frame 111 is disposed at an upper portion, and the second frame 112 is disposed at a lower portion. Therefore, for example, the upper portion and an upper end may denote a portion and an end in a direction approaching the first frame 111, in an element which is disposed in the second frame 112, and the lower portion and a lower end may denote a portion and an end in a direction approaching the second frame 112, in an element which is disposed in the first frame 111.

The movable core 130 includes a movable body 131 which is coupled to a lower end of the holder 120 to move the holder 120 in a lower direction, a connecting member 132 which is coupled to an upper end of the movable body 131, and a support 133 which connects the connecting member 132 to the holder 120 to support the movable body 131.

Here, the movable body 131 has a cylindrical structure in which a diameter is constant in an axial direction, and moreover has a structure in which the movable body 131 is insertable into a hollow part 154 of the bobbin 150.

The reason that the movable body 131 is formed in the cylindrical structure is for securing a free space, in which a DC converting circuit is provided, without enlarging a size of a product along with the fixed core 160.

Therefore, a diameter of the movable body 131 is smaller than an inner diameter of the bobbin 150, and the movable body 131 has a cylindrical shape. Accordingly, a magnitude of a magnetic force which interacts between a coil 151 of the bobbin 150 and the movable body 131 can be maximized.

In addition, a space of the hollow part 154 of the bobbin 150 is used as an inserting space of the movable body 131, and thus, a space occupied by the movable body 131 can be reduced.

The elastic member 140 elastically supports a lower end of the holder 120, and thus, when an absorbing force for moving the movable core 130 in a direction of the fixed core 160 is released, the elastic member 140 restores the movable core 130 to the original position.

To this end, a coil spring which is wound around the coil 151 in a spiral direction may be used as an example of the elastic member 140.

Figure 4:
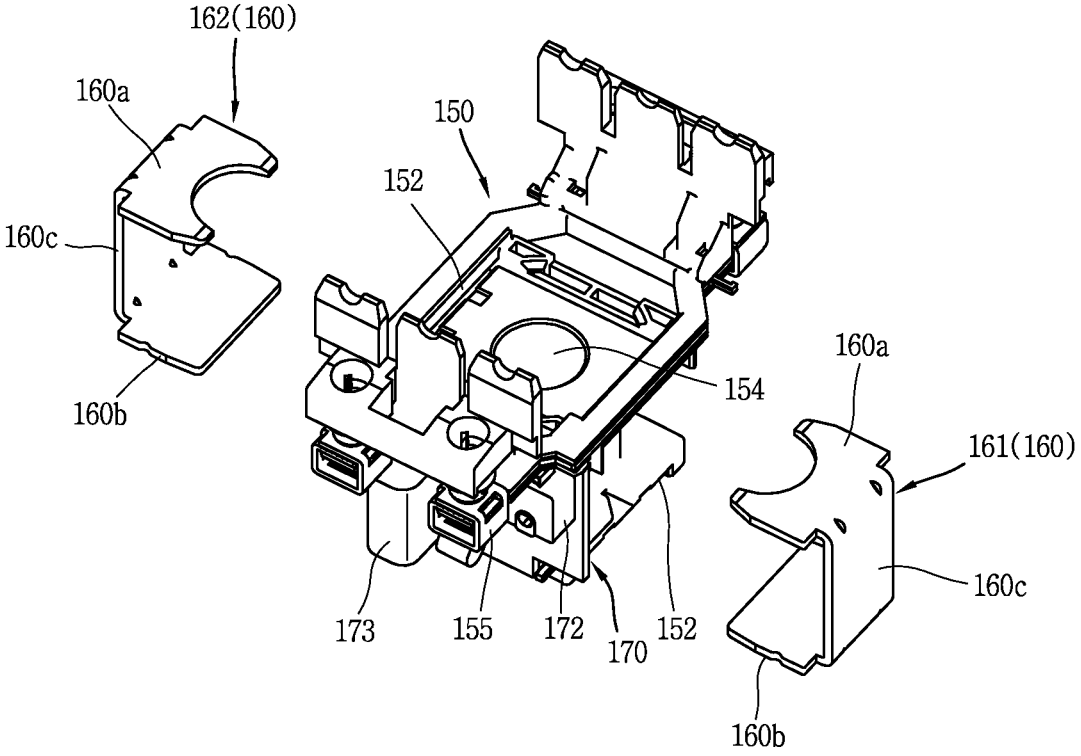
FIG. 4 is an exploded perspective view of a fixed core and a bobbin in the assembly view of FIG. 3.
Figure 5:
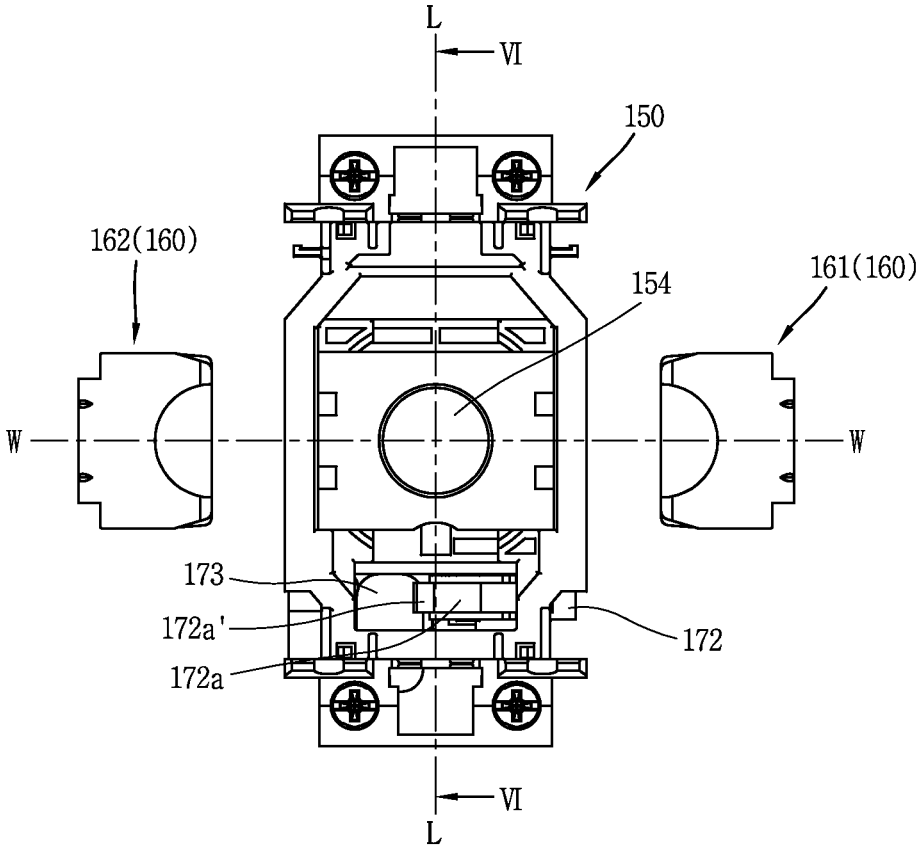
FIG. 5 is a plan view of FIG. 4.
Figure 6:
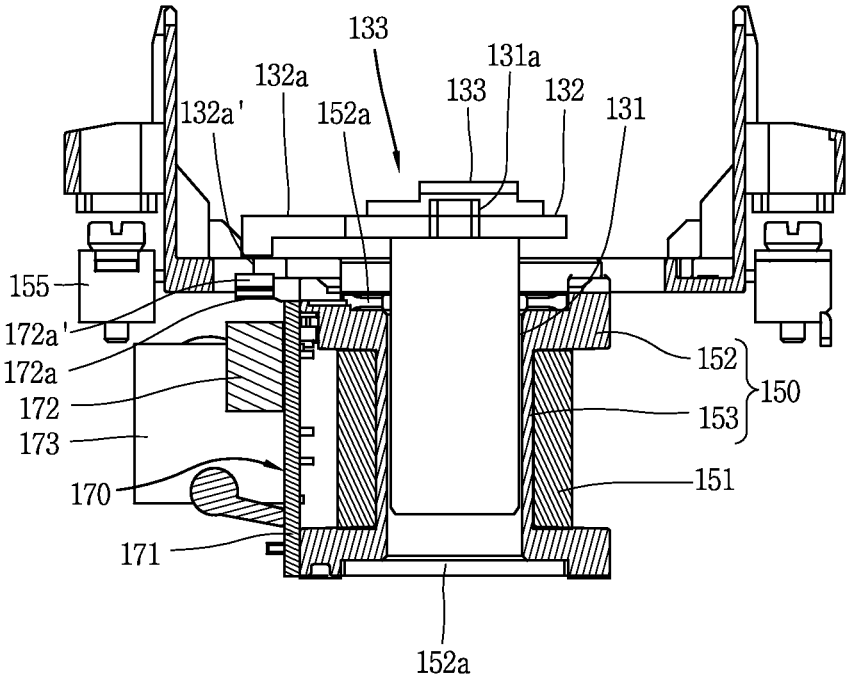
FIG. 6 is a cross-sectional view taken along line VI-VI of FIG. 5.

FIG. 4 is an exploded perspective view of the fixed core 160 and the bobbin 150 in the assembly view of FIG. 3. FIG. 5 is a plan view of FIG. 4. FIG. 6 is a cross-sectional view taken along line VI-VI of FIG. 5.

Referring to FIG. 4, the fixed core 160 includes two elements, namely, a first fixed core 161 and a second fixed core 162 which are detachable. The first fixed core 161 and the second fixed core 162 are disposed with the bobbin 150 therebetween and with an interval in a width direction W of the bobbin 150, and are inserted into and assembled with the bobbin 150.

The fixed core 160 includes upper and lower plates 160*a* and 160*b*, which are disposed with an interval therebetween in a moving direction of the movable core 130, and a side plate 160*c* (a surface parallel with a side of the bobbin 150 in a length direction L) which is connected to the upper and lower plates 160*a* and 160*b*. The fixed core 160 has a cross-sectional ⊏-shape.

Moreover, in one of characteristics of a structure of the fixed core 160, both sides of the bobbin 150 in the length direction L are fully opened. The reason that the bobbin 150 is formed in the structure is for securing a free space, in which the DC converting circuit is provided, without enlarging a size of a product along with the fixed core 160.

This is because the structure is the optimal structure in which the upper and lower plates 160*a* and 160*b* and the side plate 160*c* occupy a very small space in a product and are disposed to surround the coil 151, and thus, a magnetic path is formed by a magnetic field generated by the coil 151.

In this case, in the fixed core 160 having the cross-sectional ㄷ-shape, opening directions face each other. The fixed core 160 is assembled in order for both ends of a plate to contact each other.

In the fixed core 160 having the cross-sectional ㄷ-shape, an opening is formed in the upper plate 160*a*, and thus, the movable core 130 may be inserted into the hollow part 154 of the bobbin 150. An inner circumference surface of the upper plate 160*a* around the opening is disposed with a certain gap between the upper plate 160 and a side of the movable core 130, and thus, interference does not occur when the movable core 130 moves in a vertical direction.

Referring to FIG. 6, the electronic circuit part 170 may be disposed in parallel with the moving direction of the movable core and at one side of the bobbin 130 in the width direction W, and thus, a mobility of the movable core 130 is secured.

The bobbin 150 may include a cylindrical coil winding part 153, which includes the hollow part 154 formed therein, and a core mounting part 152 which is provided at each of an upper end and lower end of the coil winding part 153.

The coil winding part 153 may include the coil 151 which is wound around an outer surface, and when external power is applied to the coil 151, a magnetic field is generated around the coil winding part 153.

The core mounting part 152 may include a mounting groove 153*a* which is concavely formed.

The upper plate 160*a* and lower plate 160*b* of the fixed core 160 may be slidably mounted on the mounting groove 153*a*.

The upper plate 160*a* may be disposed to face the connecting member 132 of the movable core 130 with an interval therebetween in a vertical direction.

The lower plate 160*b* may be disposed to face a bottom of the movable body 131 with an interval therebetween in a vertical direction.

Therefore, a magnetic force generated by an electromagnet between the movable core 130 and the fixed core 160 can be sufficiently secured.

Moreover, a coil power input terminal 155 may be provided in the length direction L at each of ends of the power source side and the load side and on the bobbin 150, and thus, power may be applied from an external power source to the coil 151.

The electronic circuit part 170 may include various electronic elements which are mounted on a printed circuit board (PCB) 171, and control a current applied to the coil 151.

The electronic circuit part 170 may include a rectifier, an inverting switch 172, and a capacitor 173.

The rectifier may convert AC power into DC power.

The inverting switch 172 may have a mechanical mechanism relationship with the movable core 130, and when an interval between the movable core 130 and the fixed core 160 is reduced, the inverting switch 172 may sense the reduced interval.

The capacitor 173 may drop a consumption voltage of the coil 151 simultaneously with an operation (inversion) of the inverting switch 172.

The PCB 171 of the electronic circuit part 170 may be disposed in a free space, which is formed at one side of the bobbin 150 in the width direction W and is secured through an opening of width-direction side of the fixed core 160, in parallel with the moving direction of the movable core 130. Therefore, an internal space of a product occupied by the PCB 171 is minimized, and the PCB 171 does not make interference in moving of the movable core 130. Accordingly, the use of the internal space of a product can be maximized without enlarging a size of a product. Also, a separate hole may not be formed for securing a mobility of the movable core 130.

Moreover, the PCB 171 is directly coupled to one side of the bobbin 150 and is directly supplied with power, which is input through the coil power input terminal 155, from the bobbin 150 without a separate wire, and thus, a path of a current applied from the bobbin 150 to the electronic circuit part 170 is short. Therefore, a resistance can be prevented from unnecessarily increasing, and a wire can be prevented from being broken.

According to an embodiment of the present invention, mutual deviation of the support 133 and the connecting member 132 having a mechanical mechanism relationship with the inverting switch 172 can be prevented.

The connecting member 132 and the support 133 are stacked on and coupled to each other by a connecting shaft 131*a* which is provided on the movable body 131 to extend in an axial direction. In this case, a plurality of coupling holes are respectively formed at central portions of the connecting member 132 and the support 133, and the connecting shaft 131*a* are coupled to the connecting member 132 and the support 133 through the coupling holes.

Here, the connecting member 132 may be coupled to the support 133 by riveting by the connecting shaft 131*a*. The support 133 may be inserted into and coupled to the bottom of the holder 120 in a slide type through a coupling projection 133*b* which is formed at each of both sides, and thus, the holder 120 and the movable core 130 operate as one body.

In this case, since the connecting member 132 is riveted to the support 133 by the connecting shaft 131*a*, the connecting member 132 and the support 133 move in a vertical direction together. However, one of the connecting member 132 and the support 133 may rotate with respect to the other, and for example, the connecting member 32 may rotate about the connecting shaft 131*a* with respect to the support 133.

When the connecting member 132 deviates in an arbitrary direction with respect to the support 133, it is impossible to operate the inverting switch 172 having a mechanical mechanism relationship with the connecting member 132. Therefore, such a problem should be solved.

Here, the inverting switch 172 is a switch which has a normal closed (NC) type, and in which a contact is normally switched on, and when an external signal is applied, the contact is inverted into a switch-off.

The inverting switch 172 may normally connect the coil power input terminal 155 to the coil 151 to allow the external power to be applied to the coil 151, and receive an external signal from the movable core 130 through a mechanical contact.

An interval between the movable core 130 and the fixed core 160 is sensed as being reduced by the external signal, and an internal contact of the inverting switch 172 is inverted. Therefore, the external power passes through a voltage dropping element such as the capacitor 173.

This is because a magnetic force which interacts between the movable core 130 and the fixed core 160 is proportional to a level of a current flowing in the coil 151 and is inversely proportional to the square of an interval between the movable core 130 and the fixed core 160, and thus, as the interval between the movable core 130 and the fixed core 160 becomes shorter, a magnetic force generated between the movable core 130 and the fixed core 160 increases.

The interval between the movable core 130 and the fixed core 160 is large before the movable core 130 moves to the fixed core 160, and thus, a magnetic force between the movable core 130 and the fixed core 160 should be high.

However, when the movable core 130 moves to the fixed core 160, the interval between the movable core 130 and the fixed core 160 is reduced, and thus, a magnetic force and a level of a current applied to the coil 151 may be low.

Therefore, when the interval between the movable core 130 and the fixed core 160 is large, the inverting switch 172 is switched on, and then, when the interval between the movable core 130 and the fixed core 160 is reduced, the inverting switch 172 is pressed by a switch manipulating part 132*a* of the movable core 130, whereby a contact of the inverting switch 172 is switched off. Therefore, the external power may be applied not through the inverting switch 172 but through the capacitor 173, and thus, only a portion (for example, 20% to 80%) of an external source current may flow.

In this case, the connecting member 132 may include a normal position member, and prevents mutual deviation of the connecting member 132 and the support 133. Therefore, a mechanical mechanism relationship (a mechanical contact relationship) between the movable core 130 and the inverting switch 172 is maintained.

The connecting member 132 provided at one end (an upper end in the drawing) of the movable core 130 connects the movable body 131 to the holder 120, and moreover performs a switch manipulating function of operating (inverting) the inverting switch 172.

The switch manipulating function is performed according to a mechanical mechanism relationship between the movable core 130 and the inverting switch 172.

That is, when an interval between the movable core 130 and the fixed core 160 is reduced, the switch manipulating part 132*a* of the movable core 130 moves to the fixed core 160 and presses the inverting switch 172, thereby inverting the contact of the inverting switch 172.

Figure 7:
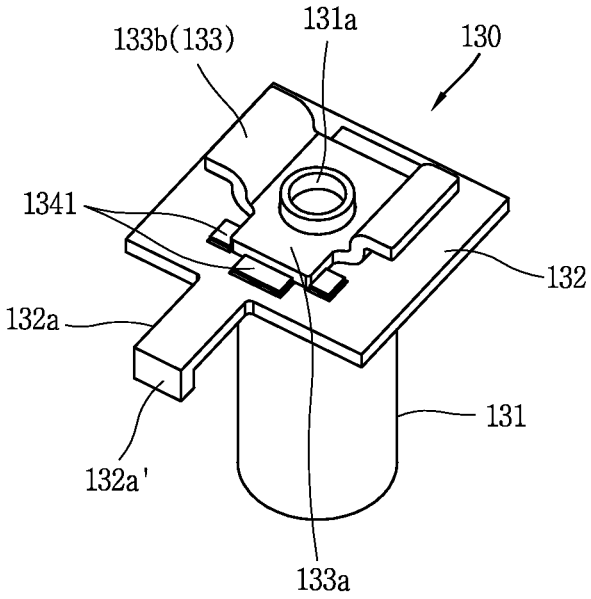
FIG. 7 is a perspective view of a movable core according to a first embodiment of the present invention.
Figure 8:
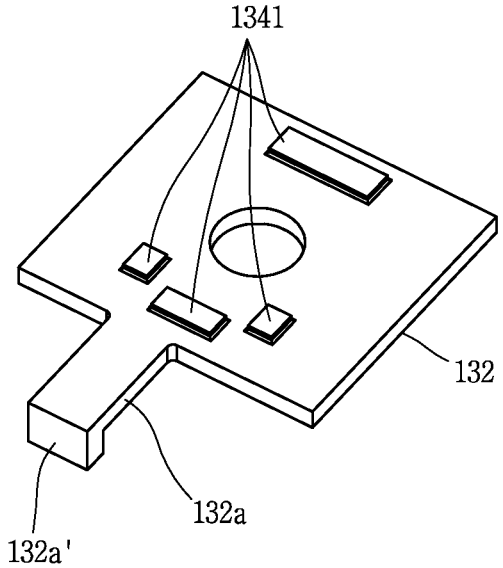
FIG. 8 is a perspective view illustrating a normal position member of FIG. 7.

Here, a mechanical mechanism relationship between the movable core 130 and the inverting switch 172 is formed according to the switch manipulating part 132*a* being pressed and contacted by a lowering motion of the movable core 130, and thus, the connecting member 132 which includes the switch manipulating part as one body should not rotate in a circumference direction at the movable core FIG. 7 is a perspective view of a movable core 130 according to a first embodiment of the present invention, and FIG. 8 is a perspective view illustrating a normal position member of FIG. 7.

As illustrated in FIG. 7, a connecting member 132 according to a first embodiment of the present invention has a tetragonal plate shape, and a switch manipulating part 132*a*, having a structure in which a length is longer than a width, is provided to protrude at one side of a tetragonal plate.

The switch manipulating part 132*a* includes a switch manipulating projection 132*a*' which is bent in a directly lower direction at one end of the switch manipulating part 132*a*.

The inverting switch 172 includes a movable contact 121 and a fixed contact 113*a*, which are normally switched on in a switch body and then are switched off when an external signal is input, and a switch operating part 172*a* which is connected to the movable contact 121 and operates according to a direct contact with a switch manipulating projection 132*a*'.

The switch manipulating part 132*a* is provided to horizontally protrude at one side of a connecting member 132, and perpendicularly intersects a virtual vertical line of the PCB 171. The switch manipulating projection 132*a*' is bent in a directly lower direction at an end of the switch manipulating part 132*a*, and contacts a contact terminal 172*a*' which is disposed at an end of the switch operating part 172*a* of the inverting switch 172.

As described above, the inverting switch 172 may be provided on the PCB 171.

For example, when width×height×thickness of the PCB 171 is 30 mm×20 mm×2 mm, the inverting switch 172 may be provided at a height position corresponding to 60% to 90% of a vertical length of a board which is vertically disposed in the drawing. The switch operating part 172*a* of the inverting switch 172 may be disposed within a moving distance range of the switch manipulating projection 132*a*', and thus, when the movable core 130 is lowered in a directly lower direction, the switch manipulating projection 132*a*' may press and invert the switch operating part 172*a* of the inverting switch 172.

Referring to FIGS. 7 and 8, a normal position member is provided as one body on the connecting member 132, and prevents the connecting member 132 from rotating in a circumference direction about a central axis line of the movable body 131 with respect to the support 133 which is fixed to the bottom of the holder 120.

The normal position member according to a first embodiment may include a projection 1341 which is formed to protrude in a strip type.

In this case, the projection 1341 is disposed adjacent to a border of the support 133. Also, a plurality of the projections 1341 are respectively disposed in at least two or more positions in different directions or a parallel direction. Therefore, mutual deviation of the projection 1341 and the support 133 is prevented, namely, the abnormal rotation of the projection 1341 is prevented. Furthermore, in the projection 1341, a length of a strip may be changed depending on a position of a border of the support 133.

For example, two of the projections 1341 are disposed in parallel in a vertical direction with respect to a protrusion direction of the switch manipulating part 132*a* so as to be adjacent to a front border and rear border of the support 133, and the other two projections 1341 are disposed in parallel with the protrusion direction of the switch manipulating part 132*a* so as to be adjacent to left and right side borders of the support 133.

As described above, the projection 1341 formed at the connecting member 132 prevents the switch manipulating part 132*a* from rotating along a circumference direction about a central axis line of the movable body 131 with respect to the support 133, namely, prevents mutual torsion of the switch manipulating part 132*a* and the support 133.

FIGS. 9 to 12 are plan views of normal position members according to various embodiments of the present invention.

Figure 9:
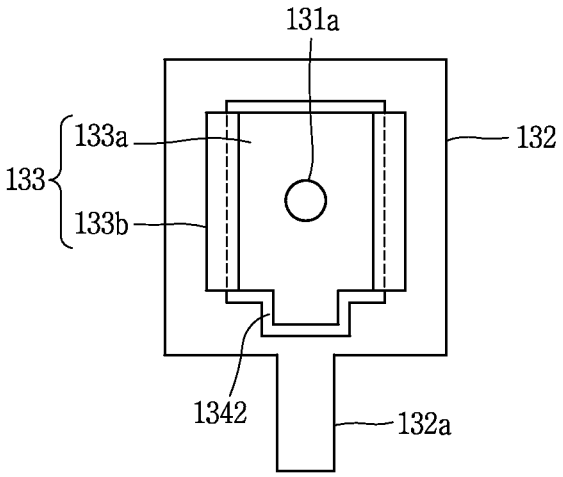
FIGS. 9 to 12 are plan views of normal position members according to various embodiments of the present invention.

In a second embodiment, as illustrated in FIG. 9, a plurality of projections 1342 may be continuously formed along a border of a support 133.

Figure 10:
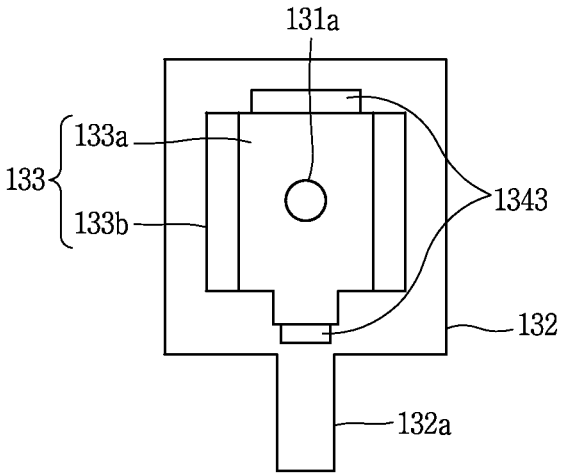

In a third embodiment, as illustrated in FIG. 10, a plurality of projections 1343 may be disposed in parallel at a border of a support 133.

Figure 11:
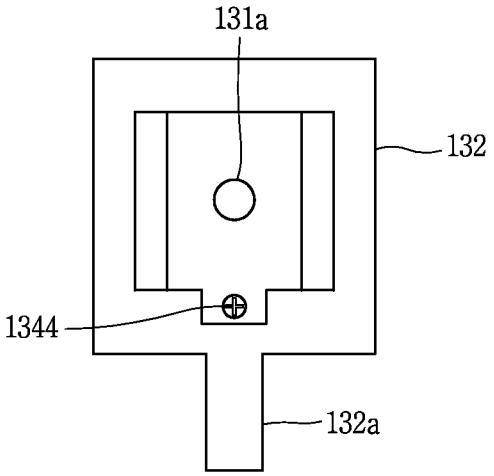

In a fourth embodiment, as illustrated in FIG. 11, a coupling member 1344 is provided at an eccentric position in a central portion of the connecting member 132, namely, the connecting shaft 131*a*, and prevents mutual torsion of the switch manipulating part 132*a* and the support 133. For example, a female screw groove may be formed at a position eccentric from the connecting shaft 131*a* and in the connecting member 132, and the coupling member 1344 such as a bolt may be coupled to the female screw groove. Alternatively, a bolt may be formed to protrude at a position eccentric from the connecting shaft 131*a* and in the connecting member 132, and the coupling member 1344 such as a nut may be coupled to the bolt.

Figure 12:
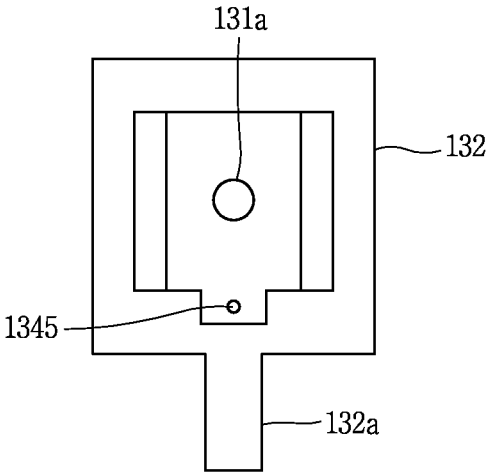

In a fifth embodiment, as illustrated in FIG. 12, an anti-torsion projection 1345 is formed at a position eccentric from the connecting shaft 131*a* and in the connecting member 132, and an anti-torsion hole is formed in the support 133. The anti-torsion projection 1345 is inserted into the anti-torsion hole. Accordingly, mutual torsion of the switch manipulating part 132*a* with respect to the support 133 can be prevented.

Figure 13:
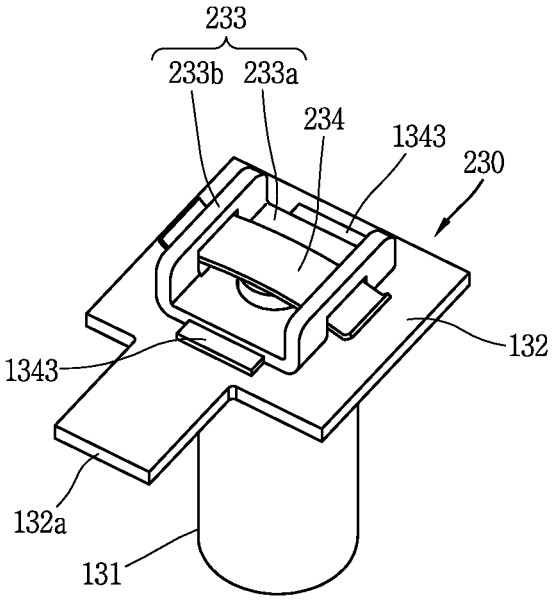
FIG. 13 is a perspective view of a support according to a second embodiment of the present invention.
Figure 14:
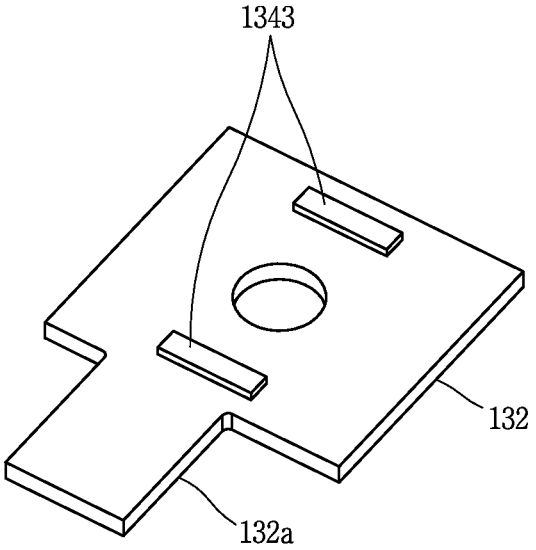
FIG. 14 is a perspective view of a connecting member of FIG. 13.

FIG. 13 is a perspective view of a support 233 according to a second embodiment of the present invention, and FIG. 14 is a perspective view of a connecting member 132 of FIG. 13.

As illustrated in FIG. 13, the support 233 may include a supporting body 233*a*, which has a tetragonal plate shape and is stacked on and coupled to an upper end of a movable body 131 along with the connecting member 132, and a side member 233*b* which is provided to extend in a direction of the holder 120 at both ends of the supporting body 233*a*. The support 233 may be stacked on and coupled to the connecting member 132 at an upper end of the a movable core 130 by using a connecting shaft 131*a*.

A coupling hole may be formed at a central portion of the supporting body 233*a*, and thus, the connecting shaft 131*a* may be coupled to the supporting body 233*a* by riveting to pass through the supporting body 233*a*.

The side member 233*b* may include an inserting hole, and a supporting pin 234 may be inserted into the side member 233*b* through the inserting hole and may protrude. Therefore, the movable core 130 may be inserted into and coupled to the bottom of the holder 120 by the supporting pin 234.

The support 233 according to the second embodiment has the same function as that of the above-described support 133 according to the first embodiment, and thus, its detailed description is not provided.

Moreover, as illustrated in FIG. 14, a normal position member may be applied between the connecting member 132 and the support 133 identically to the above-described first embodiment.

However, in the second embodiment, a plurality of switch manipulating projections 132*a*' may be formed in a bottom in a length direction at an end of a switch manipulating part 132*a* so as to be separated from each other.

Therefore, according to an embodiment of the present invention, the structures of the movable core 130 and the fixed core 160 are applied differently from the structures of the prior art movable core 130 and fixed core 160 which have an E-shape, and thus, a free space in which the DC converting circuit is provided in a product can be secured without enlarging a size of a low-capacity product.

Moreover, the normal position member is provided at the connecting member 132, and prevents mutual torsion between the connecting member 132 and the support 133. Therefore, a current applied to the coil 151 can be accurately controlled by using the mechanical mechanism relationship between the inverting switch 172 and the switch manipulating part 132*a* of the movable core 130.

As described above, in the magnetic contactor according to the embodiments of the present invention, a free space in which a DC converting circuit is provided in a product can be secured by changing a shape and structure of an electromagnet core, namely, shapes and structures of the movable core and the fixed core. Accordingly, external AC power is converted into DC power even without enlarging a size of a product in association with a low-capacity product.

Moreover, the normal position member is included in the movable core and induces the movable core to a normal position, and thus, the switch manipulation part included in the movable core can maintain a mechanical mechanism relationship with another element.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A magnetic contactor comprising:

a frame configured to include a fixed contact which is connected to a power source and a load;

a holder movably provided in the frame, and configured to include a movable contact and a fixed contact which are disposed to contact each other and to be separated from each other;

a movable core coupled to one end of the holder, and configured to include a switch manipulating part;

a bobbin configured to include a coil which is wound around an outer surface, wherein the bobbin generates a magnetic force when external power is applied to the coil;

a fixed core coupled to the bobbin;

an elastic member disposed between the holder and the bobbin, wherein the elastic member restores the movable core to an original position when the external power is cut off;

an inverting switch provided within a moving range of the switch manipulating part, wherein an internal contact of the inverting switch is inverted when the inverting switch is contacted by switching manipulating part;

an electronic circuit part configured to include a voltage dropping element, and receive an inversion signal from the inverting switch to control a current applied to the coil; and a normal position member configured to fix the switch manipulating part to a normal switch to induce a contact between the inverting switch and the switch manipulating part.

2. The magnetic contactor of claim 1, wherein the movable core has a structure in which the movable core is inserted into the bobbin, and is movable within a certain distance.

3. The magnetic contactor of claim 1, wherein the fixed core has a box-shaped structure in which the fixed core is opened in both directions, and the fixed core is hollow.

4. The magnetic contactor of claim 2, wherein the fixed core is symmetrically separated with respect to a length-direction central line of the bobbin, and is detachably coupled to a side of the bobbin.

5. The magnetic contactor of claim 1, wherein the electronic circuit part is provided at one side of the bobbin.

6. The magnetic contactor of claim 1, wherein, the movable core comprises:

a connecting member coupled to a connecting shaft which is provided to protrude at one end of a movable core body, and configured to include the switch manipulating part which is operably provided as one body; and a support stacked on and coupled to the connecting member by using the connecting shaft, and configured to connect the holder to the connecting member, and the normal position member comprises a protrusion formed to protrude on a boundary line between the support and the connecting member, and configured to prevent mutual torsion of the support and the connecting member.

7. The magnetic contactor of claim 6, wherein the protrusion is continuously formed to protrude along a border of the support.

8. The magnetic contactor of claim 6, wherein a plurality of the protrusions are respectively formed in at least two borders, which are in different directions or in a parallel direction, among a plurality of borders of the support.

9. The magnetic contactor of claim 6, wherein the protrusion has a strip structure in which a plurality of the protrusions are formed to protrude in parallel at a border of the support.

10. The magnetic contactor of claim 2, wherein the support comprises:

a supporting plate stacked on the connecting member; and a coupling projection formed at both ends of the support to extend toward the holder, wherein an end of the coupling projection is formed to protrude in an axial direction.

11. The magnetic contactor of claim 2, wherein the connecting member is coupled to the support by riveting by a connecting shaft.

12. The magnetic contactor of claim 2, wherein the support comprises:

a supporting body stacked on the connecting member;

a side member formed at both ends of the supporting plate to protrude toward the holder, and configured to include an inserting hole; and a supporting pin coupled to the side member through the inserting hole, and coupled to the holder at both ends of the supporting pin.

13. The magnetic contactor of claim 1, wherein, the movable core comprises:

a connecting member coupled to a connecting shaft which is provided to protrude at one end of a movable core body, and configured to include the switch manipulating part which is operably provided as one body; and a support stacked on and coupled to the connecting member by using the connecting shaft, and configured to connect the holder to the connecting member, and the normal position member comprises a coupling member configured to couple the support to the connecting member to prevent mutual torsion of the support and the switch manipulating part.

14. The magnetic contactor of claim 1, wherein, the movable core comprises:

a connecting member coupled to a connecting shaft which is provided to protrude at one end of a movable core body, and configured to include the switch manipulating part which is operably provided as one body; and a support stacked on and coupled to the connecting member by using the connecting shaft, and configured to connect the holder to the connecting member, and the normal position member comprises an anti-torsion projection separated from the connecting shaft at the connecting member, formed to protrude, and coupled to the support to pass through the support.

* * * * *